United States Patent [19]

Groenewold

[11] Patent Number: 4,880,235

[45] Date of Patent: Nov. 14, 1989

[54] SIMULATED ANIMAL RACING TRACK APPARATUS

[76] Inventor: William H. Groenewold, 1435 Shawnee, BourBonnais, Ill. 60914

[21] Appl. No.: 261,160

[22] Filed: Oct. 24, 1988

[51] Int. Cl.[4] ..... A63F 9/14

[52] U.S. Cl. ..... 273/86 R; 446/2

[58] Field of Search ..... 273/86 R, 86 D, 391; 446/2

[56] References Cited

U.S. PATENT DOCUMENTS

| | | | |
|---|---|---|---|
| 2,402,390 | 6/1946 | Gardner | 446/2 |
| 2,535,973 | 12/1950 | Voges | 273/391 |
| 2,587,042 | 2/1952 | Haiselup | 273/391 X |
| 2,776,835 | 1/1957 | Wilson | 273/86 R |
| 3,315,404 | 4/1967 | Rosen | 446/2 |
| 4,138,797 | 2/1979 | Stolar | 446/2 |
| 4,358,274 | 11/1982 | Chase | 446/2 X |
| 4,632,664 | 12/1986 | Manning | 446/2 |
| 4,715,602 | 12/1987 | May et al. | 273/86 R |
| 4,740,185 | 4/1988 | Inglee | 446/2 |

*Primary Examiner*—Anton O. Oechsle

*Attorney, Agent, or Firm*—Henderson & Sturm

[57] ABSTRACT

A simulated animal race track apparatus including a track and having a first and second plurality of animal-shaped members spaced apart in two lines and which are tippable from an upright position to a tipped position using a domino affect and simulating the motion of a horse galloping and the clatter of the horses' hooves as the horses strike each other.

4 Claims, 6 Drawing Sheets

SIMULATED ANIMAL RACING TRACK APPARATUS

TECHNICAL FIELD

The present invention relates generally to a simulated animal race track apparatus, and more particularly to such a simulated racing track which has horses with jockeys thereon which tip, one into another, in a domino affect to simulate a horse race.

BACKGROUND ART

There is a great deal of interest in animal racing such as in the racing of horses and dogs. A problem associated with those interested in observing this sport is that they are limited to attending such events only when and where they actually occur. Consequently, considerable travel may be necessary to attend such an event and of course scheduling problems arise as well.

Of course there is also a considerable demand for home entertainment games as is well known. For example, U.S. Pat. No. 2,776,835 is an example of a racing game apparatus which utilizes a domino affect for home entertainment purposes, but to date there does not exist a simulated horse racing apparatus which simulates the action and sound of a race track.

DISCLOSURE OF THE INVENTION

The present invention relates generally to a simulated animal race track apparatus including a track and having a first and second plurality of animal-shaped members spaced apart in two lines and which are tippable from an upright position to a tipped position using a domino affect and simulating the motion of a horse galloping and the clatter of the horses' hooves as the horses strike each other.

An object of the present invention is to provide an apparatus to simulate a horse race or the like.

A further object of the present invention is to simulate a horse race in a way that uses a similar motion and which achieves a similar noise like horses' hooves striking the track.

A further object of the present invention is to provide an apparatus of the aforementioned type having a reset structure thereon.

A further object of the present invention is to provide an apparatus of the aforementioned type with a feature for simultaneous starting of a horse race simulation.

A still further object of the present invention is to provide an apparatus of the aforementioned type having a structure associated therewith for easily determining the winner in even a close simulated race.

Other objects, advantages, and novel features of the present invention will become apparent from the following detailed description of the invention when considered in conjunction with the accompanying drawings.

BEST MODES FOR CARRYING OUT THE INVENTION

Figure 1:
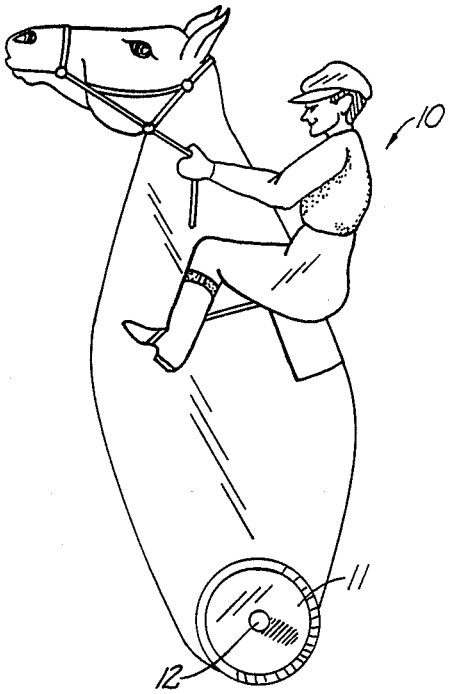
FIG. 1 is a side elevational view of a wooden horse and rider for use in conjunction with the present invention.
Figure 2:
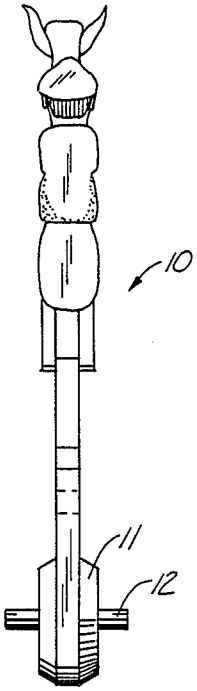
FIG. 2 is a rear view of the horse and rider of FIG. 1.

Referring now to the drawings wherein like reference numerals designate identical or corresponding parts throughout the several views, FIG. 1 shows a wooden horse and rider (10) having a circular portion (11) and a dowel-like axle (12) at the bottom thereof. It will be understood of course that this horse could be in different configurations, and even in the shape of different animals, such as a dog without a rider instead of in the configuration shown.

Figure 3:
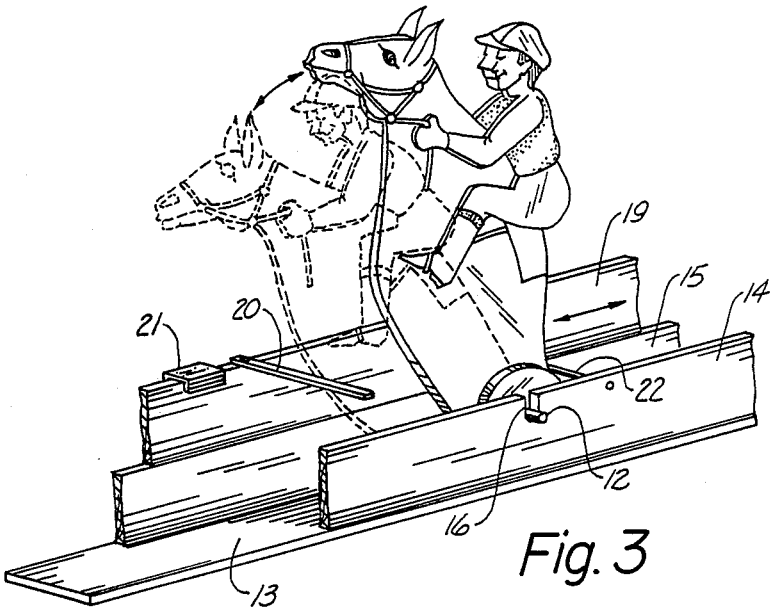
FIG. 3 is a perspective view of the horse and rider of FIG. 1, showing it in an upright over-center position in solid lines and in a tipped position in dashed lines.
Figure 5:
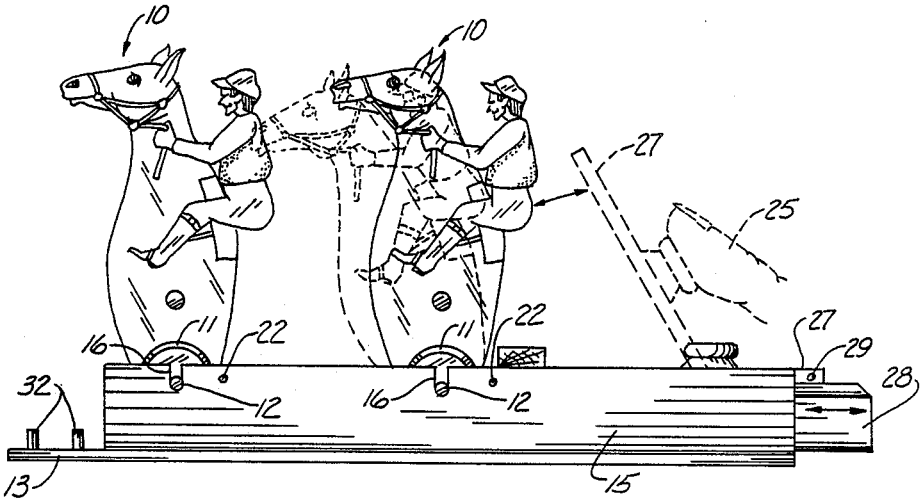
FIG. 5 is a side elevational view of FIG. 4 and showing in solid lines the position of the horse and rider before it is started and in dashed lines showing the beginning of the simulated race by showing one horse tipping into another horse which would cause the second horse also to tip to the left as shown in FIG. 5.

FIG. 3 shows one-half of a race track (13) having upstanding walls (14) and (15). Grooves (16) and (17) are provided in the top edges of upstanding walls (14) and (15) and a balancing pin (22) is rigidly attached across and between the upstanding walls (14) and (15) for supporting the horse and rider (10) in the position shown in solid lines in FIG. 3 wherein the center of gravity of the horse and rider (10) is slightly to the right of the axis of the pin (12), for example as shown in FIG. 5.

Figure 11:
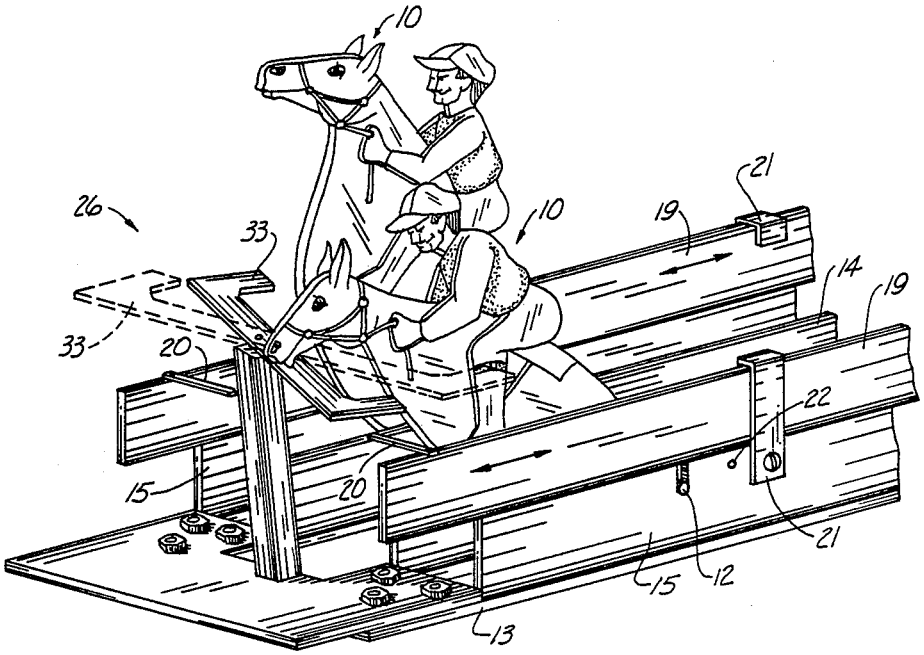
FIG. 11 is a perspective view of a finish of a race if the set of horses in the foreground wins.

A reset bar (19) has a plurality of projections (20) thereon and the reset bar (19) slides on top of the member (15) and is prevented from falling off of the member (15) because of metal clips (21) which extend over the top of the reset bar (19) and which are rigidly attached to the upstanding wall (15), for example as shown in FIG. 11.

FIG. 16 shows an alternate embodiment of the wall (14) which has a hole (18) therein instead of a slot (16) so that the axles (12) are permanently held in place.

Figure 6:
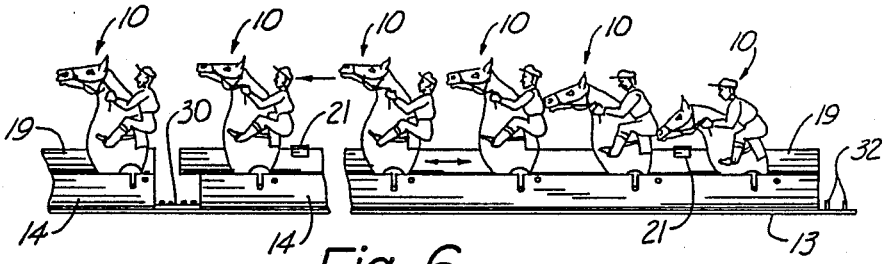
FIG. 6 is a side elevational view of a section of the track with two of the horses tipped and the third horse beginning to tip forward to show the action of the horse simulation apparatus of the present invention.
Figure 7:
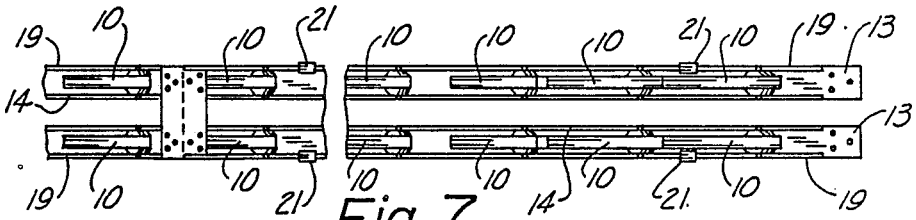
FIG. 7 is a top view of what is shown in FIG. 6.
Figure 8:
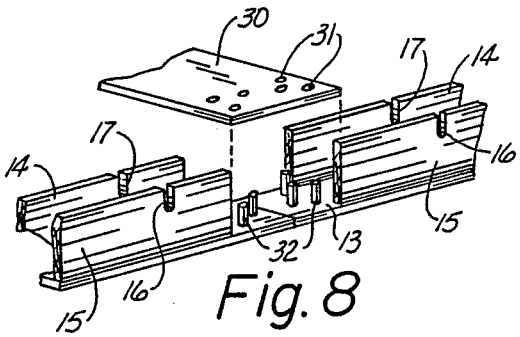
FIG. 8 shows a connecting structure for connecting together sections of the track and also for mounting the two parts of the track side-by-side so that two sets of horses can run thereon.
Figure 14:
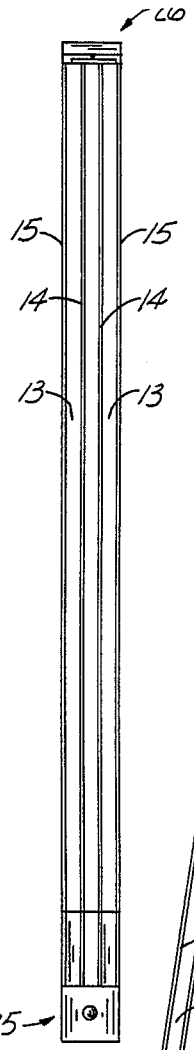
FIG. 14 shows a straight track similar to that shown in FIGS. 6 and 7.

Referring to the FIG. 14 embodiment of the track which has a starting block apparatus (25) at one end thereof, the tracks (13) with sides (14) and (15) thereon and with a finish marker (26) at the other end thereof. Sections of the track (13) are connected together by a plate (30) having a plurality of holes (31) disposed in each end thereof for slipping over pins (32) on the ends of the track section (13). This can readily be seen in FIGS. 6–8.

Figure 4:
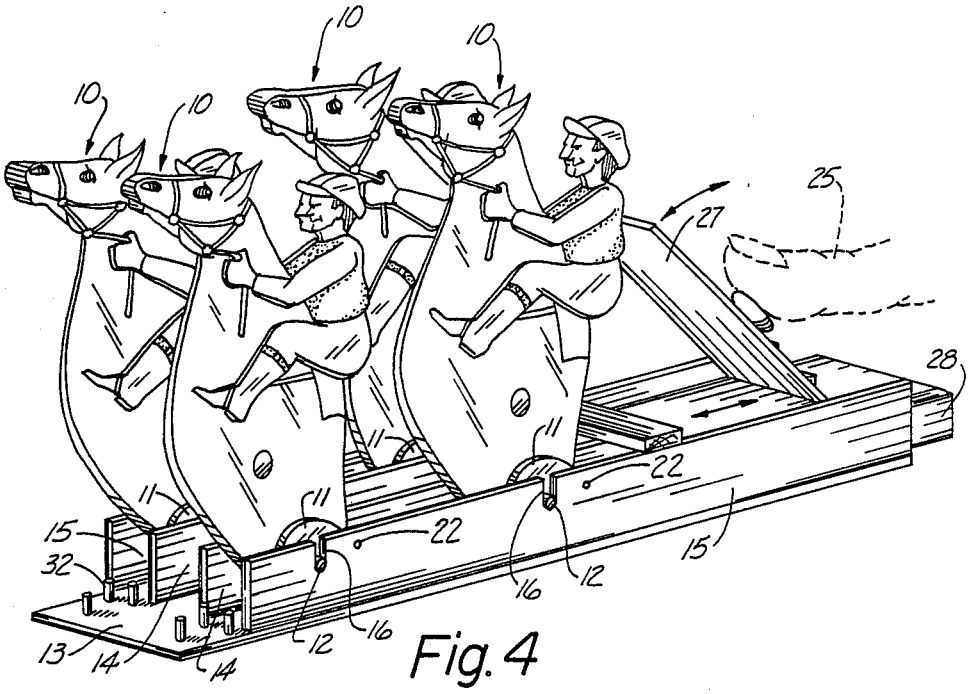
FIG. 4 is a perspective view of a starting block structure and showing one section of the race track with two sets of horse and riders thereon for starting both sets of horse and riders simultaneously.

In operation of the preferred embodiment of FIG. 14, it is noted that the starting gate apparatus (25) is moved from the position shown in solid lines in FIG. 5 wherein the plate (27), which is pivotally attached to block (28) at pin (29) is first moved to the dashed line position shown in FIG. 5 and the solid line position shown in FIG. 4. Then by pushing on the knob of gate (27) to pivot the gate (27) toward the horses (10), this will begin the domino affect wherein the horses (10) will move sequentially from the solid line position shown in FIG. 5 to the dashed line position shown in FIG. 5 which will cause the next forward horse (10) to also be tipped, for example as sequentially shown in FIG. 6 until all of the horses in both of the lanes (13) have been tipped.

If the plurality of horses (10) in the foreground finishes first, then the finish line marker (33) will move from the dashed line position shown in FIG. 11 to the solid line position shown in FIG. 11 and in this position, the farthest away end of the lever (33) will hold the last horse in the background in an upright position while allowing the last horse in the foreground to be tipped forward. This will indicate to the players of this game that the group of horses in the foreground has finished first. This is particularly important in a very close race.

Figure 12:
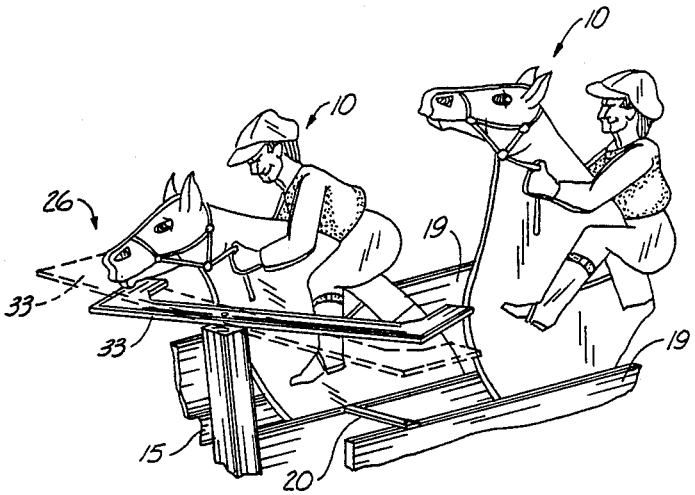
FIG. 12 is a perspective view of the position of the finish bar and the horses if the set of horses in the background finishes first.

On the other hand, if the group of horses in the background all tip first, then the lever (33) will move to the position shown in solid lines to the position shown in dashed lines in FIG. 12 whereby the background horse will be tipped forward, and the foreground horse (10) will be prevented from tipping forward to indicate that all of the horses in the background have tipped over before all of the horses in the foreground have tipped.

When it is desired to reset the horses (10) to simulate another race, the reset member (19) is merely pulled back toward the starting gate (25) so that the bars (20) push and tip all of the horses (10) back against the bars (17), which are behind each horse (10). The horses will then remain in that position until started again. Of course once they are reset, then the reset bar (19) is moved back to the position shown in FIG. 3.

Figure 9:
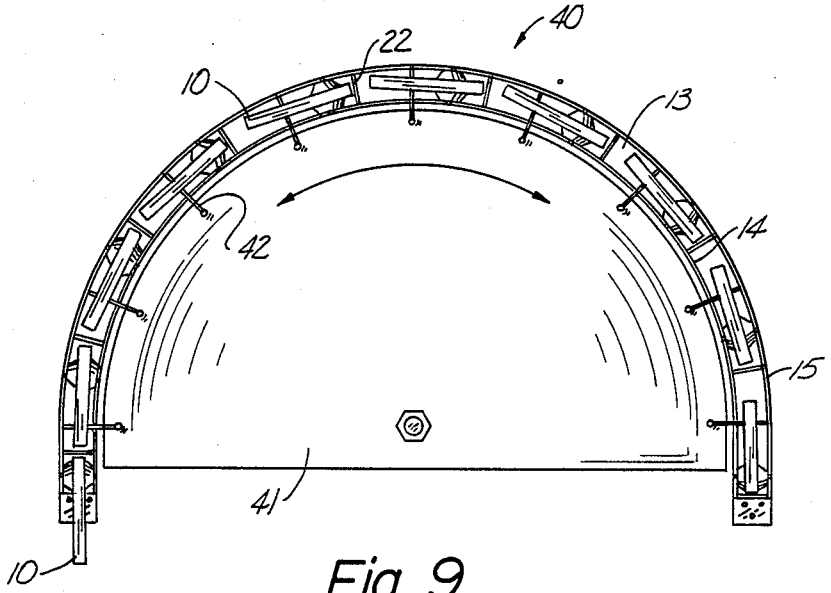
FIG. 9 is a top view of a circular section of the track shown in FIG. 13.
Figure 10:
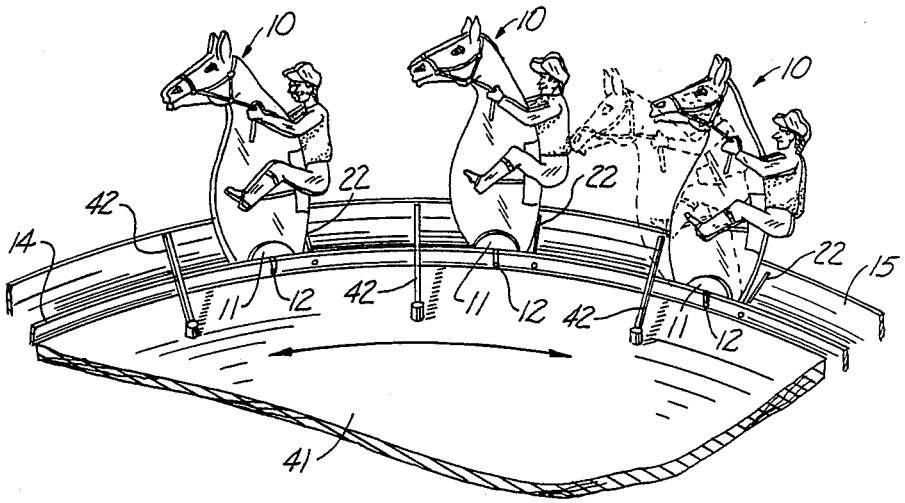
FIG. 10 is an enlarged side elevational view of the semi-circular portion of the track shown in FIG. 9 in perspective.
Figure 13:
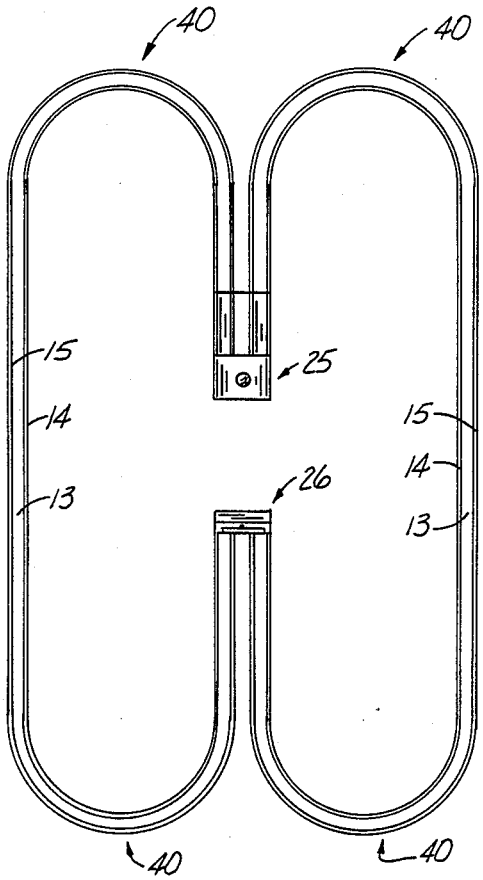
FIG. 13 is a top view of an alternate form of the track which starts out straight and then is curved in the intermediate portion of the race and then which is straight again at the end of the race.
Figure 15:
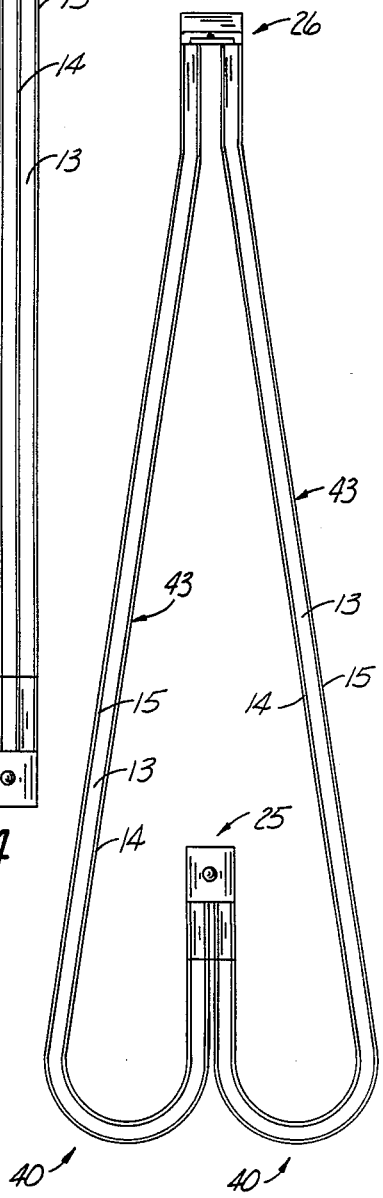
FIG. 15 shows another possible configuration of the track, shown from above.

Referring to FIG. 9, it is noted that this structure can be utilized to form certain other configurations of tracks such as that shown in FIGS. 13 and 15. A semi-circular reset plate (41) has a plurality of projections (42) thereon which are similar in function to the reset bars (20) as shown in FIGS. 3 and 16. The walls (14) and (15) are essentially the same as before except that they are curved and the horse and riders (10) are identical to that used in the staightaway sections. Consequently, the configuration (40) shown in FIG. 9 would be used four different places in FIG. 13 and in two different places in the configuration of the track of FIG. 15.

In order to simulate a horse race on the track of FIG. 13, the starting gate (25) is actuated as before as shown in FIGS. 4 and 5. Then the two sets of horse and riders (10) will move around the track on the straight away and on the curve until they arrive at the finish line (26), in which case the finish line apparatus (33) will be utilized just as in FIGS. 11 and 12 to determine the winner.

To reset the horse and riders on the straight away, the reset bars (19) are used on the straight away sections of the track (13). However, on the curve, the reset structure (41) and (42) are used by simply turning semi-circular plate (41) to the right to reset the horses in their upright position and then moving the semi-circular plate (41) back to the position shown in FIG. 9 when the race is being run.

The operation of the FIG. 15 configuration is also practically identical to the operation just described for FIG. 13 wherein the two sets of horses and riders (10) are started at the starting block (25), and they move through the straight away and around the curves (40) and into another straight away section (43) until ultimately getting into the finish section (26) to hit the bar (33). The straight away sections (43) can have reset arms (19) and the curve sections (40) will have reset structures (41) and (42) just like that shown in FIG. 9.

Accordingly, it will be appreciated that the preferred embodiment shown herein do indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A simulated animal race track apparatus comprising:

a track; having upstanding walls and a reset bar slideably disposed on top of one of the upstanding walls wherein the reset bar is provided with a first plurality of spaced projections which extend in the direction of the other of the upstanding walls; and, wherein the reset bar is operatively engaged to the said one of the upstanding walls;

a first plurality of animal-shaped members spaced apart in a first line sequentially from one end of said track to the other end thereof;

a second plurality of animal-shaped members spaced apart in a second line sequentially from one end of said track to the other end thereof;

means for independently, pivotally attaching each of said first animal-shaped members along a horizontal axis, each of said first animal-shaped members being mounted for pivotal movement about a different horizontal axis wherein each of said horizontal axes is equally spaced from each other adjacent horizontal axis;

means for independently, pivotally attaching each of said second animal-shaped members along a horizontal axis, each of said second animal-shaped members being mounted for pivotal movement about a different horizontal axis wherein each of said horizontal axes associated with said second animal-shaped members is equally spaced from each other adjacent horizontal axis associated with said second animal-shaped members;

means for holding each animal-shaped member in an over-center generally upright position;

means for permitting each of said animal-shaped member to pivot to a tipped position into contact with the animal-shaped member directly in front of it for causing the sequential pivoting of each animal-shaped member from said upright to said tipped position thereof; and, means attached to one end of said track for simultaneously starting a first pair of said animal-shaped members to move from the upright to said tipped position; wherein said first plurality of spaced projections are adapted to engage opposed pairs of animal-shaped members operatively disposed on said track.

2. The apparatus as in claim 1 wherein said track further comprises straight track sections and curved track sections wherein said reset bar is operatively associated with said straight track sections.

3. The apparatus as in claim 2 further comprising:

a semi-circular reset plate operatively associated with the curved track sections wherin the reset plate is provided with a second plurality of spaced projections which are adapted to engage opposed pairs of animal-shaped members operatively disposed on said curved track sections.

4. The apparatus as in claim 1 including means attached to the other end of said track for determining which plurality of animal-shaped members finishes the sequential tipping process first.

* * * * *